United States Patent [19]

Catallo

[11] Patent Number: 4,689,862

[45] Date of Patent: Sep. 1, 1987

[54] METHOD AND APPARATUS FOR THE COMPRESSIVE TREATMENT OF FABRIC

[76] Inventor: Frank Catallo, 84 Wheatley Rd., Old Westbury, N.Y. 11568

[21] Appl. No.: 856,613

[22] Filed: Apr. 25, 1986

[51] Int. Cl.[4] ..... D06C 21/00

[52] U.S. Cl. ..... 26/18.6

[58] Field of Search ..... 26/18.6; 264/282; 162/111, 280, 361

[56] References Cited

U.S. PATENT DOCUMENTS

| | | | |
|---|---|---|---|
| 1,548,790 | 8/1925 | Lorenz | 26/18.6 X |
| 3,426,405 | 2/1969 | Walton | 26/18.6 |
| 3,452,409 | 7/1969 | Trifunovic et al. | 26/18.6 |
| 3,869,768 | 3/1975 | Walton et al. | 26/18.6 |
| 4,363,161 | 12/1982 | Catallo | 26/18.6 |
| 4,447,938 | 5/1984 | Catallo | 26/18.6 |

*Primary Examiner*—Robert R. Mackey

[57] ABSTRACT

An improved method and apparatus for the compressive treatment of material are disclosed. The method and apparatus use a gull winged confining means in conjunction with two surfaces to form a stuffing chamber. The wing of the confining means which faces the first, faster moving surface is provided with a precompacting zone where the wing and first moving surface are spaced more than at other positions between the wing and first moving surface.

10 Claims, 3 Drawing Figures

METHOD AND APPARATUS FOR THE COMPRESSIVE TREATMENT OF FABRIC

BACKGROUND

1. Field of the Invention

The invention relates to a method and apparatus for the compressive treatment of web material in order to mechanically impart pre-shrinkage and stretch properties to the material.

2. Description of the Related Art

There are a number of different machines and methods available for effecting a compressive force on thread interlaced web material in order to impart pre-shrinkage properties. In my previous patents, U.S. Pats. Nos. 4,363,161 and 4,447,938, I disclosed such methods and apparatus.

The method disclosed in U.S. Pat. No. 4,363,161 comprises forcing a fibrous thread interlaced web material into a stuffing chamber where the stuffing chamber is formed by a confining means having an apex and two movable surfaces with the apex extending in part between the surfaces. One of the surfaces is moved with respect to the confining means in a direction toward the stuffing chamber at a particular speed in order to feed a web of material into the chamber. The second movable surface moves in a direction substantially opposite to the direction of movement of the first surface and at a slower speed to move compressed material out of the stuffing chamber.

U.S. Pat. No. 4,447,938 discloses a similar method and apparatus. However, it includes the provision of an impact blade. The impact blade is used when greater shrinkage control is desired. In this situation, the fabric must be compressed to a greater extent. Under high fabric compression forces, the fabric tends to be forced into the nip area between the moving surfaces instead of around the apex. The impact blade prevents this and directs the fabric around the apex.

SUMMARY OF THE INVENTION

The present invention is a modification of the previous methods of compressive treatment of fabrics. The modification improves the appearance and shrinkage of the treated materials. Also, it eliminates many of the fine operator adjustments normally required, especially on lighter weight fabrics.

The new method includes the steps of forcing the material into a stuffing chamber defined by two surfaces moving at different rates and a confining means having an apex between the surfaces, as disclosed in my earlier patents. The flow of the material is along the moving surfaces and around the apex of the confining means. In the present invention, a precompacting zone is provided in the confining means adjacent the first or faster moving surface. The material is compressed into a recess of the precompacting zone and localized pressure is provided to the fabric above the apex of the confining means in the area of the recessed portion of the confining means.

The apparatus of the invention comprises a first movable surface movable at a particular speed in a first direction and a second movable surface is located adjacent the first movable surface and movable in a second direction opposite to that of the first surface and at a speed slower than that of the first surface. A confining means having an apex is provided to extend partway between the two surfaces whereby the space between the two surfaces and the confining means defines a stuffing chamber. The surface of the confining means adjacent the first movable surface is provided with a precompacting zone. That is, the separation between the first movable surface and the surface of the confining means is increased in a zone near the apex of the confining means.

The confining means is in the form of a gull-shaped member similar to that disclosed in U.S. Pat. No. 4,363,161. The gull-shaped member has two wings; one wing is spaced from the first faster moving roll and is provided with a relief or recess to form a zone for precompacting the fabric prior to its entering the stuffing chamber. The second wing is spaced from the second slower surface. The second wing does not conform exactly to the second moving surface, and thereby the second moving surface may provide localized pressure to the fabric and the confining means.

DESCRIPTION OF THE PREFERRED EMBODIMENT

Figure 2:
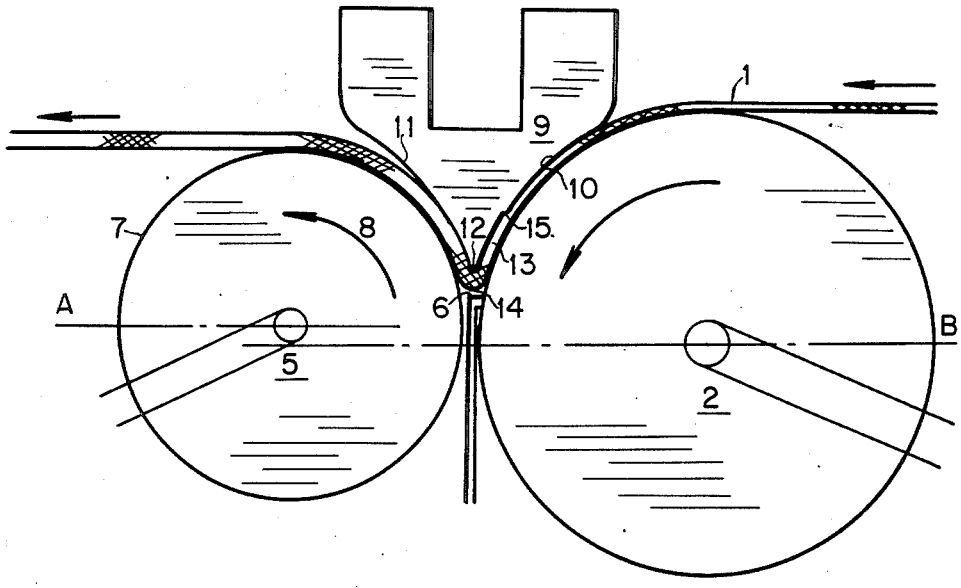
FIG. 2 is a diagrammatic side view of the apparatus of the invention having unequal diameter rolls.

Referring to FIG. 2, there is illustrated an apparatus for the compressive treatment of a web 1 of fibrous thread interlaced web material which is fed by roll 2 having outer convex surface 3 and which rotates in the direction shown by the arrow 4. A second roll 5 is positioned adjacent roll 2 to form a nip area 6. Roll 5 has an outer surface 7 and rotates in the direction shown by the arrow 8. As can be seen therefore, the roll surfaces 3 and 7 move in opposite directions in the nip area 6 of the rolls.

Figure 1:
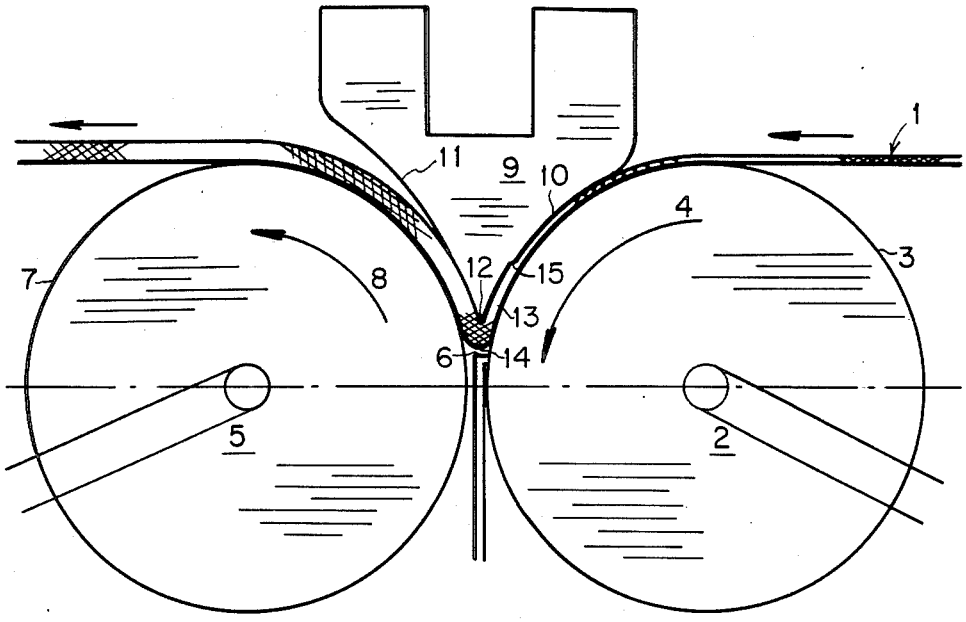
FIG. 1 is a diagrammatic side view of the apparatus of the invention having two equal diameter rolls.

The rolls in FIG. 2 are shown as having an unequal diameter which is preferred. Specifically, roll 5 is of slightly smaller diameter than roll 2. The unequal rolls have offset centers so that smaller roll 5 is positioned higher than roll 2 as shown by center lines A,B. Alternatively the rolls may be of equal diameters as shown in FIG. 1.

Figure 3:
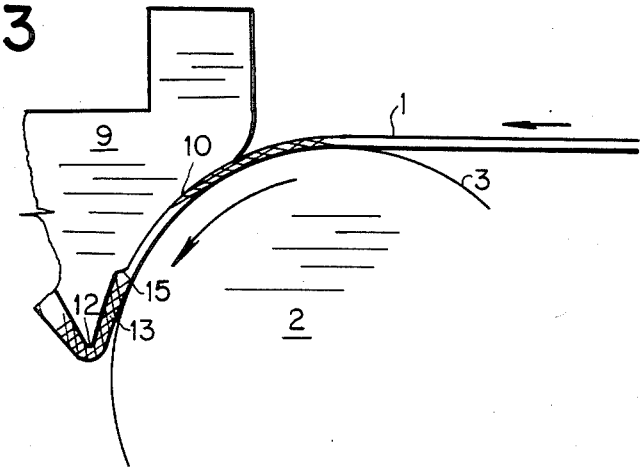
FIG. 3 is a partial diagrammatic view of the apparatus showing an exagerated precompacting zone.

A confining means 9 is positioned above the rolls. The confining means has a gull-wing shape formed by wings 10, 11 which meet at an arcuate apex 12. Wing 10 adjacent to roll 2 follows surface 3 of roll 2 closely in a first portion, maintaining a substantially constant spacing of wing 10 from roll 2. However, in a second portion which forms precompacting zone 13, the spacing of wing 10 increases (FIG. 3). In the presently preferred construction, the depth of precompacting zone 13 is equal to the original spacing of wing 10 from roll 2 in the first portion, plus the original thickness of the web, however, it may be slightly smaller. Also, in the presently preferred construction, the length of the recess is not less than three times the original thickness of the web and preferably twenty times the original thickness of the web. This structure allows the web to thicken slightly by collecting in precompacting zone 13 to provide controlled shrinkage.

In operation, the web 1, prior to compressive compacting, is fed by the roll 2 along wing 10 of the confining means into a stuffing chamber 14 defined by confining means 9 and rolls 2, 5. Roll 5 rotates at a slower speed than roll 2 and thereby creates a compressive force in web 1. The compressive force acts on web 1 from point 15 at the beginning of the precompacting zone 13 to the point where the web leaves the stuffing chamber 14 by passing between roll 5 and wing 11.

As the web passes along roll 2, the stitches of the web accumulate in the recess of precompacting zone 13, and the forces of their movement through the zone are distributed and equalized over a greater number of stitches. The resistance of any one stitch gives to the forces of the surrounding stitches to balance the forces resulting in uniformity of fabric compression. The fabric is prevented from buckling by low localized pressure of roll 5 provided by the small radius of roll 5 compared to the radius of curvature of wing 11. Roll 5 is smaller than roll 2 and located to make primary contact with the material above the apex 12 of the confining means in an area aligned with the top of the precompacting zone 13.

In this way the fabric passes through the stuffing chamber after being precompacted in precompacting zone 13, thus eliminating abrupt change or rearrangement of stitches. This results in a more effective action on each stitch with uniform orientation of the stitches. The surface and edges remain smooth and flat, free of corrugations or imperfections. The compressive treatment of fabric in this improved apparatus provides web shrinkage which is improved because of a larger percentage or all of the stitches have been affected by the uniformity provided by zone 13.

An alternate embodiment uses two rolls of equal diameter as shown in FIG. 1. In this embodiment the wings of the confining means are not shaped symmetrically. Specifically, wing 11 has a larger radius of curvature than wing 10 allowing the roll to provide contact at a point aligned with the beginning of precompacting zone 13. This allows roll 5 to provide the necessary localized pressure even though the rolls are of equal diameter.

I claim:

1. An apparatus for the compressive treatment of fibrous thread interlaced material having an initial thickness comprising:

(a) a first movable uninterrupted cylindrical surface;
(b) means for moving the first movable surface at a first speed;
(c) a second movable uninterrupted surface;
(d) a confining means spaced from the first and second movable surfaces, having a smooth arcuate apex and extending between the first and second surfaces to form a stuffing chamber therewith into which material is adapted to be moved by the first movable surface and from which material is adapted to be moved by said second movable surface around the apex;
(e) said confining means including a first concave confining surface of uniform smoothness connecting with said apex and spaced from and opposite the first movable cylindrical surface and having a first portion adjacent the apex which is spaced a greater distance from said first movable surface than a second portion located further from the apex to provide a precompacting zone; and
(f) means for moving the second movable surface in a direction opposite the first movable surface at a speed slower than said first speed to move said material therealong at a retarded speed less than the first speed to thereby precompact the material in said precompacting zone.

2. The apparatus according to claim 1 wherein:

(a) said first portion of said concave confining surface is spaced from said first movable surface by an amount equal to the spacing of the second portion plus the initial thickness of the material being treated.

3. An apparatus for the compressive treatment of fibrous thread interlaced material having an initial thickness comprising:

(a) a first movable uninterrupted cylindrical surface;
(b) means for moving the first movable surface at a first speed;
(c) a second movable uninterrupted surface;
(d) means for moving the second movable surface in a direction opposite the first movable surface at a speed slower than said first speed;
(e) a confining means spaced from the first and second movable surfaces, having a smooth arcuate apex and extending between the first and second surfaces to form a stuffing chamber therewith into which material is adapted to be moved by the first movable surface and from which material is adapted to be moved by said second movable surface around the apex;
(f) said confining means including a first concave confining surface connecting with said apex and spaced from and opposite the first movable cylindrical surface and having a first portion adjacent the apex which is spaced a greater distance from said first movable surface than a second portion located further from the apex to provide a precompacting zone;
(g) said confining means further including a second surface connecting with said apex and spaced from and opposite the second movable surface; and
(h) the second movable surface is aligned with the second surface of the confining means to make primary contact with the material passing therebetween at a point on the second surface of the confining means spaced from said apex and substantially aligned with the junction of the first and second portions of the first concave confining surface of the confining means to provide a localized pressure on said material at said point.

4. The apparatus according to claim 3 wherein:

(a) the second movable surface is cylindrical.

5. The apparatus according to claim 4 wherein:

(a) the cylinder of the second movable surface has a diameter smaller than the diameter of the cylinder of the first movable surface;
(b) the second movable surface has a center of rotation which is above a center of rotation of the first movable surface as measured from the apex of said confining means and positioned to cause the second movable surface to press the material against the concave confining means at a point aligned with the junction of the first and second portions of the first concave surface.

6. The apparatus according to any one of claims 1–5 wherein:

(a) the first portion of said concave confining surface extends in the direction of movement of the first movable surface a distance equal to twenty times the initial thickness of the material.

7. A method for the compressive treatment of a fibrous thread interlaced web material wherein said web is forced into a stuffing chamber formed by a space between a first movable uninterrupted cylindrical surface and a second movable uninterrupted surface and a smooth arcuate apex of a confining means extending in part between and spaced from the first and second surfaces with the confining means having a concave confining surface of uniform smoothness connecting with said apex opposite said first surface and spaced from said first surface by a first distance along a first portion of said concave confining surface and spaced a second distance greater than said first distance along a second portion of said concave confining surface comprising the steps of:

(a) moving the first surface at a first rate of speed to move the web between said first surface and the confining surface along said first portion toward said stuffing chamber;

(b) moving the web into the space between the second portion of said concave confining surface allowing the web to precompact therein without buckling;

(c) moving the web into the stuffing chamber; and (d) moving said second surface at a second rate of speed slower than said first rate of speed in a direction opposite the movement of said first surface to move said material around said apex, out of said stuffing chamber and along and between said second surface and said confining means while retarding the speed of the web to cause said precompacting.

8. The method according to claim 7 wherein:

(a) said web is in the space defined by said second portion of said concave confining surface and said first surface as it travels a distance not less than three times the original thickness of the fabric.

9. The method according to claim 8 wherein:

(a) said web is in the space defined by said second portion of said concave confining surface and said first surface as it travels a distance equal to twenty times the thickness of the web.

10. A method for the compressive treatment of a fibrous thread interlaced web material wherein said web is forced into a stuffing chamber formed by a space between a first movable uninterrupted cylindrical surface and a second movable uninterrupted surface and a smooth arcuate apex of a confining means extending in part between and spaced from the first and second surfaces with the confining means having a concave confining surface of uniform smoothness connecting with said apex opposite said first surface and spaced from said first surface by a first distance along a first portion of said concave confining surface and spaced a second distance greater than said first distance along a second portion of said concave confining surface comprising the steps of:

(a) moving the first surface at a first rate of speed to move the web between said first surface and the confining surface along said first portion toward said stuffing chamber;

(b) moving the web into the space between the second portion of said concave confining surface allowing the web to precompact therein without buckling;

(c) moving the web into the stuffing chamber;

(d) moving said second surface at a second rate of speed slower than said first rate of speed in a direction opposite the movement of said first surface to move said material around said apex, out of said stuffing chamber and along and between said second surface and said confining means while retarding the speed of the web to cause said precompacting; and (e) applying a localized pressure to the material passing between said second surface and confining means at a point spaced from said apex and substantially aligned with the junction of the first and second portions of the first concave confining surface of the confining means.

* * * * *